US007909101B2

(12) United States Patent
Conrad

(10) Patent No.: US 7,909,101 B2
(45) **Date of Patent: *Mar. 22, 2011**

(54) APPARATUS AND METHOD FOR INCREASING WELL PRODUCTION

(75) Inventor: Greg Allen Conrad, Pocola, OK (US)

(73) Assignee: Nalco One Source, LLC, Pocola, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/983,719

(22) Filed: Nov. 9, 2007

(65) Prior Publication Data

US 2008/0066919 A1 Mar. 20, 2008

Related U.S. Application Data

(63) Continuation of application No. 10/905,993, filed on Jan. 28, 2005, now Pat. No. 7,311,144.

(60) Provisional application No. 60/617,837, filed on Oct. 12, 2004.

(51) Int. Cl.
*E21B 43/16* (2006.01)
*E21B 43/25* (2006.01)

(52) U.S. Cl. ..... 166/300; 166/309

(58) Field of Classification Search ..... 166/270.1, 166/300, 309, 310, 242.3
See application file for complete search history.

(56) References Cited

U.S. PATENT DOCUMENTS

| | | | |
|---|---|---|---|
| 2,620,740 | A | 12/1952 | Garrett et al. |
| 3,050,121 | A | 8/1962 | Garrett et al. |
| 3,096,819 | A | 7/1963 | White, Jr. et al. |
| 3,712,129 | A | 1/1973 | Rhoades |
| 3,980,136 | A | 9/1976 | Plummer et al. |
| 4,414,846 | A | 11/1983 | Dublin, Jr. et al. |
| 5,033,550 | A | 7/1991 | Johnson et al. |
| 5,152,343 | A | 10/1992 | Kilgore |
| 5,339,905 | A | 8/1994 | Dowker |
| 5,535,767 | A | 7/1996 | Schnatzmeyer et al. |
| 5,803,167 | A | 9/1998 | Bussear et al. |
| 5,871,049 | A | 2/1999 | Weaver et al. |
| 6,257,332 | B1 | 7/2001 | Vidrine et al. |
| 6,405,803 | B1 | 6/2002 | Giroux et al. |
| 6,464,004 | B1 | 10/2002 | Crawford et al. |

(Continued)

FOREIGN PATENT DOCUMENTS

| | | | |
|---|---|---|---|
| EP | 0699821 | A1 | 6/1996 |

*Primary Examiner* — Daniel P Stephenson
(74) *Attorney, Agent, or Firm* — Edward O. Yonter; Michael B. Martin

(57) ABSTRACT

An apparatus and method for hydrocarbon recovery in a well for coal bed methane (CBM) recovery, tight sand gas extraction, and other gas extraction techniques provides for the formation of a hydrocarbon foam comprised of a fluid delivered into a downhole portion of the well and the hydrocarbon, maximizing water removal for gas recovery. The apparatus may include a check valve that feeds a nozzle to deliver or atomize the spray of fluid into the downhole portion of the well when the pressure applied to the fluid is sufficient to overcome a hydrostatic pressure in the downhole portion of the well and to deliver the fluid into the downhole portion of the well. The fluid is not sprayed directly into the formation, thereby protecting the formation from damage and recovering the fluid even in the case where water is not present. The capillary tube feeding the fluid to the check valve may be placed externally to the production tube to facilitate ease of cleaning and clearing of the production tube.

25 Claims, 4 Drawing Sheets

U.S. PATENT DOCUMENTS 6,619,402 B1 9/2003 Amory et al.
6,880,639 B2 * 4/2005 Rhodes et al. ..... 166/321
7,341,108 B2 3/2008 Naizer et al.
2001/0017157 A1 8/2001 Pringle
2004/0060703 A1 4/2004 Stegemeier et al.
2004/0262011 A1 12/2004 Huckabee et al.

* cited by examiner

APPARATUS AND METHOD FOR INCREASING WELL PRODUCTION

CROSS REFERENCE TO RELATED APPLICATIONS

This application is a continuation of and claims the benefit of U.S. utility patent application no. 10/905,993, filed on Jan. 28, 2005, and entitled "Apparatus and Method for Increasing Well Production Using Surfactant Injection," now U.S. Pat. No. 7,311,144, which in turn claimed the benefit of U.S. provisional patent application no. 60/617,837, filed on Oct. 12, 2004, and entitled "Apparatus and Method for Increasing Well Production Using Surfactant Injection." Each of these applications is incorporated herein by reference.

TECHNICAL FIELD

The present invention relates to gas recovery systems and methods, and in particular to an apparatus and method for increasing the yield of a methane well using direct injection of surfactant at the end of a well bore incorporating a downhole valve arrangement.

BACKGROUND OF THE INVENTION

It has long been recognized that coalbeds often contain combustible gaseous hydrocarbons that are trapped within the coal seam. Methane, the major combustible component of natural gas, accounts for roughly 95% of these gaseous hydrocarbons. Coal beds may also contain smaller amounts of higher molecular weight gaseous hydrocarbons, such as ethane and propane. These gases attach to the porous surface of the coal at the molecular level, and are held in place by the hydrostatic pressure exerted by groundwater surrounding the coal bed.

The methane trapped in a coalbed seam will desorb when the pressure on the coalbed is sufficiently reduced. This occurs, for example, when the groundwater in the area is removed either by mining or drilling. The release of methane during coal mining is a well-known danger in the coal extraction process. Methane is highly flammable and may explode in the presence of a spark or flame. For this reason, much effort has been expended in the past to vent this gas away as a part of a coal mining operation.

In more recent times, the technology has been developed to recover the methane trapped in coalbeds for use as natural gas fuel. The world's total, extractable coal-bed methane (CBM) reserve is estimated to be about 400 trillion cubic feet. Much of this CBM is trapped in coal beds that are too deep to mine for coal, but are easily reachable with wells using drilling techniques developed for conventional oil and natural gas extraction. Recent spikes in the spot price of natural gas, combined with the positive environmental aspects of the use of natural gas as a fuel source, has hastened development of coal-bed method recovery methods.

The first research in CBM extraction was performed in the 1970's, exploring the feasibility of recovering methane from coal beds in the Black Warrior Basin of northeast Alabama. CBM has been commercially extracted in the Arkoma Basin (comprising western Arkansas and eastern Oklahoma) since 1988. As of March 2000, the Arkoma Basin contained 377 producing CBM wells, with an average yield of 80,000 cubic feet of methane per day. Today, CBM accounts for about 7% of the total production of natural gas in the United States.

While some aspects of CBM extraction are common to the more traditional means of extracting oil, natural gas, and other hydrocarbon fuels, some of the problems faced in CBM extraction are unique. One common method generally used to extract hydrocarbon fuels from within minerals is hydraulic fracturing. Using this technique, a fracturing fluid is sent down a well under sufficient pressure to fracture the face of the mineral formation at the end of the well. Fracturing releases the hydrocarbon trapped within, and the hydrocarbon may then be extracted through the well. A proppant, such as course sand or sintered bauxite, is often added to the fracturing fluid to increase its effectiveness. As the pressure on the face of the fractured mineral is released to allow for the extraction of the hydrocarbon fuel, the fracture in the formation would normally close back up. When proppants are added to the fracturing fluid, however, the fracture does not close completely because it is held open by the proppant material. A channel is thus formed through which the trapped hydrocarbons may escape after pressure is released.

Although course fracturing of this type is very successful in some applications, it has not proven particularly useful in the recovery of CBM. Coal fines recovered with the water and methane during CBM extraction will quickly foul the well when course fracturing techniques are used. This necessitates the frequent stoppage of CBM recovery in order that the production tubing may be swabbed or cleaned. It has been found that course fracturing will significantly reduce both the long-term productivity and ultimate useful life of a CBM well.

While traditional fracturing has proven unsuccessful in CBM extraction, all coal beds contain cleats, that is, natural fractures through which CBM may escape. As hydrostatic pressure is decreased at the cleat by the removal of groundwater, methane within the coal will naturally desorb and move into the cleat system, where it may flow out of the coal bed. CBM may thus be withdrawn from the coalbed in this manner through the well, without the necessity in many cases of any artificial fracturing methods. CBM exploration and well placement strategies thus are highly dependent upon a good knowledge of cleat placement within the coalbed of interest.

If artificial fracturing processes are used to stimulate production in CBM wells, they must be very gentle so as not to harm the coalbed cleats, and thereby reduce rather than increase well production. Acids, xylene-toluene, gasoline-benzene-diesel, condensate-strong solvents, bleaches, and course-grain sand have been found to be detrimental to good cleat maintenance. Recent experience in coalbeds in the Arkoma Basin indicates that a mixture of fresh water with a biocide, combined with a minimal amount of friction reducer, may be the least damaging fracturing fluid. The failure to use gentle fracturing methods and other good production practices elsewhere in a coal bed can even damage production at nearby wells.

Regardless of whether a fracturing liquid is used in CBM extraction, some means must be provided for the removal of the significant quantity of groundwater expelled as a result of the process. One study found that the average CBM well removed about 12,000 gallons of water per day. Pump jacks and surfactant (soap) introduction are the most common means of removing this water. Pump jacks, which have been used for decades in traditional petroleum extraction, simply pump water out of the well by mechanical means. A pump is placed downhole, and is connected to a rocking-beam activator at the wellhead by means of an interconnected series of rods. Pump jacks are expensive to install, operate, and maintain, particularly in CBM applications where bore cleaning is required more often due to the presence of coal fines. The presence of the pump jack at the end of the well also requires lengthier downtimes when maintenance is performed, reducing the cost-efficiency of the well.

In contrast to the pump jack method, the surfactant method relies upon the hydrostatic pressure within the well itself to force groundwater up through the borehole and out of the extraction area. The surfactant combines with the groundwater to form a foam, which is pushed back up through the well by hydrostatic pressure. The water/surfactant mixture is then separated from the devolved methane gas and disposed of by appropriate means. Ideally, not all water is removed at the point of CBM extraction; rather, only enough water is removed such that the hydrostatic pressure in the area of the borehole is reduced just enough that the methane bound to the coal will desorb. In this way, damage to the coalbed cleats in the area of the borehole is minimized. Care must be exercised to prevent the surfactant from entering the coal formation, since this too may damage the coalbed cleats and reduce the production rate and lifetime of the well.

Two methods are commonly used today for the introduction of surfactant into a CBM well. One method is the dropping of "soap sticks" into the well. The soap sticks form a foam as they are contacted by water rising up through the well, thereby forming foam that travels up and out of the well due to hydrostatic pressure. The second method is to attach a small tube inside the main production tube and pour gelled surfactant into this tube. The surfactant travels down the tube through the force of gravity, capillary action, or its own head pressure, eventually depositing the gel into the flow of water in the well and forming a foam. Again, this foam rises back up through the well for eventual removal. Use of either of these methods is believed by the inventor to increase well production on average by 10-20%.

Although a significant amount of CBM is extracted through vertical drilling methods, horizontal drilling methods have become more common. The general techniques for horizontal drilling are well known, and were developed for conventional extraction of oil and natural gas. In the usual case, the well begins into the ground vertically, then arcs through some degree of curvature to travel in a generally horizontal direction. Horizontal wells thus contain a bend or "elbow," the severity of which is determined by the drilling technique used. It is believed that horizontal drilling may result in better extraction rates of CBM from many coal beds due to the way in which coalbeds tend to form in long, horizontal strata. One analysis has shown that "face" cleats in coalbeds appear to be more than five times as permeable as "butt" cleats, which form orthogonally to face cleats. A horizontal well can increase productivity by orienting the lateral section of the well across the higher-permeability face cleats. As a result of these effects, the area drained by a horizontal well may be effectively much larger than the area drained by a corresponding vertical well placed into the same coalbed stratum. Horizontal well CBM extraction thus promises greater production from fewer wells in a given coalbed. The first horizontally drilled CBM wells in the Arkoma Basin were put in place around 1998.

While horizontal drilling promises improved theoretical productivity over vertical drilling in many instances, it raises several problems of its own that are unique to CBM extraction. It may be seen that the deposit of a "soap stick" in a horizontal well will result in the movement of the soap stick only to the bottom of the "elbow" of the well. The soap stick is carried by gravity to this point, but will not proceed past the point where the well turns. Thus this method will form no foam at the end of the well bore at all; foam is only formed at the point where the soap stick comes to rest. The inventor has recognized that increased productivity would result from the production of foam at the end of the well, which is just at the point where the water is being extracted from the coal bed seam. The soap stick will never reach this point.

Likewise, the method of introducing a surfactant by dripping a gel into the well also suffers when horizontal drilling techniques are used. Gravity, capillary action, or head pressure are the only agents moving the gel down into the well. In actual practice, the lines used to deliver this gel (typically ⅜ inch stainless steel tubing) cannot be made to reach to the bottom of the well, since the weight of the capillary tubing is not sufficient to overcome the frictional force arising from contact with the tubing walls, due to the arc in the horizontal well "elbow." Again, as in the case of the soap stick, foam will not be formed at the end of the well where it is needed most.

Another disadvantage of the gel capillary tube approach is that the tubing is employed inside the main production tube in the well; thus when the main production tube plugs or otherwise requires maintenance, the gel delivery tubing will impede efforts to clean, clear, or otherwise maintain the production tube. This is a particular problem in CBM extraction because of the fouling problems presented by coal fines, and the resulting need to regularly swab or clean the well tubing. Finally, since the gel is not introduced under pressure, it cannot adjust to the hydrostatic pressure at the end of the well. This pressure is dependent upon the depth of the well and the height of the water table. If the hydrostatic pressure is significantly less than the gel pressure, then the gel may flow out the production tube and into the coal bed, thereby damaging the coal bed cleats and retarding future production. If the hydrostatic pressure is significantly greater than the gel pressure, then the gel will flow little or not at all, producing minimal foam and impeding removal of groundwater and thus reducing CBM extraction rates.

While this discussion has focused on CBM extraction, another developing area for the recovery of natural gas from unconventional sources is the extraction of natural gas from sandstone deposits. Sandstone formations with less than 0.1 millidarcy permeability, known as "tight gas sands," are known to contain significant volumes of natural gas. The United States holds a huge quantity of these sandstones. Some estimates place the total gas-in-place in the United States in tight gas stands to be around 15 quadrillion cubic feet. Only a small portion of this gas is, however, recoverable with existing technology. Annual production in the United States today is about two to three trillion cubic feet. Many of the same problems presented in CBM extraction are also faced by those attempting to recover natural gas from tight gas sands, and thus efforts to overcome problems in CBM extraction may be directly applicable to recovery from tight gas sands as well.

What is desired then is an apparatus for and method of introducing surfactant into a borehole for CBM extraction, tight sand gas extraction, or other types of gas-recovery options, where such apparatus and method is well-suited to horizontally drilled wells and that produces foam at the tip of the borehole for optimal groundwater removal, while preventing the flow of surfactant into the formation itself in conditions of potentially varying hydrostatic pressure.

BRIEF SUMMARY OF THE INVENTION

The present invention is directed to an apparatus and method for injecting surfactant into a well utilizing a capillary tube and injection subassembly. The injection subassembly comprises a hydrostatic control valve and nozzle that injects surfactant through an atomizer arrangement at the downhole end of the production tube in the well. The capillary tube travels along the outside of the production tube rather than the inside, thereby leaving the inner portion of the production tube unobstructed. The hydrostatic control valve allows the pressure at which the surfactant is injected to be controlled, such that the surfactant atomizes and shears with the gas and water at the downhole end of the production tube with greater efficiency.

This apparatus and method results in a number of important advantages over prior art techniques. The surfactant may be directed at exactly the point where it is needed most, that is, at the downhole end of the production tube. By thoroughly mixing the water with surfactant at this point through the use of an atomizer on the valve, water may be more efficiently drawn out of the formation and up through the well tube. Since the surfactant is being directed into the production tube, rather than into the formation itself, there is no danger of significant quantities of surfactant being introduced into the formation, thereby reducing well yields. Even in the case when no water is present, the surfactant will be brought back to the surface by the flow of gas up through the production tube since it leaves the valve in an atomized state. The valve is adjustable to allow for the depth of the well, such that the optimum pressure may be applied to result in good foam body without excessive pressure, thereby minimizing any damage to the formation and maximizing the usable life of the well. Compared to typical surfactant introduction methods that yield increased well production of 10-20%, testing of the present invention in CBM extraction, as well as tight sand gas extraction, has yielded production increases of over 100% in most cases.

It is therefore an object of the present invention to provide for an apparatus and method for injecting surfactant into a well such that surfactant and water are mixed at or near the end of the well production tube.

It is a further object of the present invention to provide for an apparatus and method for injecting surfactant into a well such that surfactant and water are well mixed in order to more efficiently move water from the downhole formation.

It is also an object of the present invention to provide for an apparatus and method for injecting surfactant into a well such that surfactant is inhibited from entering the formation.

It is also an object of the present invention to provide for an apparatus and method for injecting surfactant into a well such that surfactant does not significantly enter the formation even when no water is present.

It is also an object of the present invention to provide for an apparatus and method for injecting surfactant into a well such that the pressure at which surfactant is injected is adjustable.

It is also an object of the present invention to provide for an apparatus and method for injecting surfactant into a well such that a minimum pressure is utilized for drawing water/surfactant from a well, thereby reducing formation damage.

It is also an object of the present invention to provide for an apparatus and method for injecting surfactant into a well that significantly increases gas yields over conventional surfactant introduction methods.

These and other features, objects and advantages of the present invention will become better understood from a consideration of the following detailed description of the preferred embodiments and appended claims in conjunction with the drawings as described following:

DETAILED DESCRIPTION OF THE INVENTION

Figure 1:
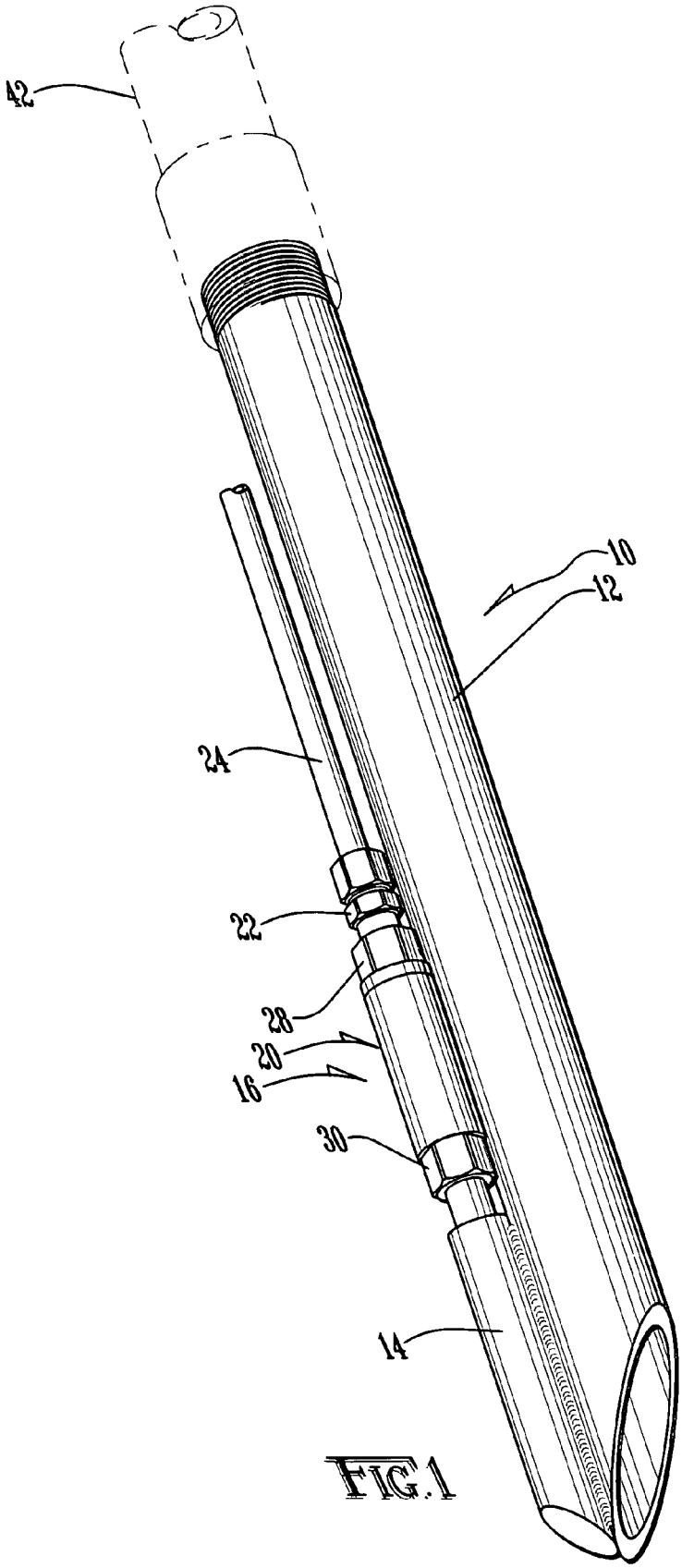
FIG. 1 is an elevational view of a downhole tube assembly according to a preferred embodiment of the present invention.

With reference to FIG. 1, the downhole injection subassembly 10 of a preferred embodiment of the present invention for use in connection with CBM extraction may be described. Although the discussion of the preferred embodiment will focus on CBM extraction, it may be understood that the preferred embodiment is applicable to other gas extraction techniques, including without limitation tight sand gas extraction.

Downhole injection subassembly 10 is designed for deployment at the end of a production tube for placement in a well. The external portions of downhole injection subassembly 10 are composed of production tube tip 12 and injection sheath 14. In the preferred embodiment, production tube tip 10 is a tube constructed of steel or other appropriately strong material, threaded to fit onto the downhole end of a production tube. In the preferred embodiments, production tube 10 is sized to fit either of the most common 2⅜ inch or 2⅞ inch production tube sizes used in CBM extraction. In alternative embodiments, other sizes may be accommodated. The distal end of production tube tip 10 may be beveled for ease of entry into the well casing. In the preferred embodiment, the hollow interior of production tube tip 10 is kept clear in order to minimize blockage and facilitate periodic swabbing and cleaning.

Figure 2:
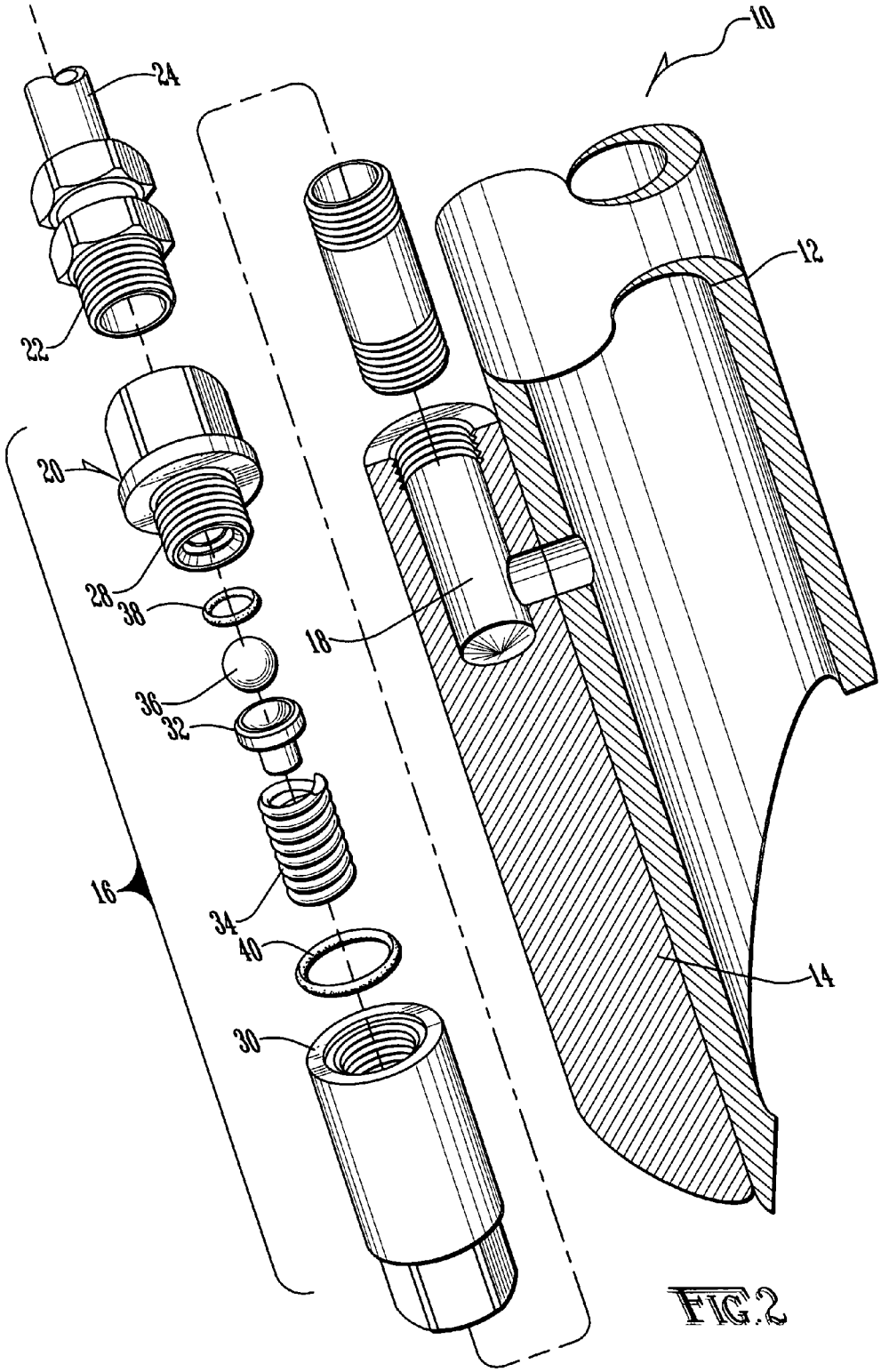
FIG. 2 is a partial cut-away exploded view of a downhole tube assembly and injection subassembly according to a preferred embodiment of the present invention.

Attached at the downhole end of production tube tip 12 by welding or other appropriate means is injection sheath 14. Injection sheath 14 protects valve/sprayer subassembly 16, as shown in FIG. 2. Like production tube tip 10, injection sheath 14 may be constructed of steel or another appropriately strong material. In the preferred embodiment, the tip of injection sheath 14 is tapered in a complementary way to that of production tube tip 12, thereby forming a pointed "nose" on the end of the production tube that eases insertion of the production tube into a well.

Referring now to FIG. 2, the components of valve/sprayer subassembly 16 may be described. Nozzle 18 is mounted near the end of production tube tip 12, and oriented such that surfactant introduced to nozzle 18 is sprayed into production tube tip 12. In the preferred embodiment, an opening is provided in the side of production tube tip 12 for this purpose. The size of this opening is roughly one-fourth of an inch in diameter in the preferred embodiment, although other sizes may be employed in other embodiments based upon the exact size and construction of nozzle 18. Nozzle 18 is preferably of the atomizer type, such that surfactant introduced to nozzle 18 under appropriate pressure will be atomized as it leaves nozzle 18 and enters production tube tip 12. Provided that water is present at the end of production tube tip 12, this water will be thoroughly mixed with the surfactant thereby forming a foam, which will then be forced to the surface through the production tube along with the evolved gas due to the hydrostatic pressure in the formation.

Feeding surfactant to nozzle 18 is valve 20. As explained further below in reference to FIG. 3, valve 20 opens to allow surfactant into nozzle 18 when the appropriate pressure is applied to the incoming surfactant. The pressure required to open valve 20 will depend upon the hydrostatic pressure at the end of the production tube where valve 20 is located. In the preferred embodiment, valve 20 is threaded on either end to receive nozzle 18 and fitting 22. Fitting 22 is used to connect valve 20 to capillary tube 24. In the preferred embodiment, fitting 22 connects to valve 20 using pipe threads, and connects to capillary tube 24 using a compression, flare, or other tube-type fitting. In alternative embodiments, fitting 22 may be omitted if valve 20 is configured so as to connect directly to capillary tube 24.

Banding 26 is used to hold capillary tube 26 against production tube tip 12 and the production tube along its length. Banding 26 is preferably thin stainless steel for strength and corrosion-resistance, but other appropriate flexible and strong materials may be substituted. In the preferred embodiment, banding 26 is placed along capillary tube 24 roughly every sixty feet along its length. At the surface, capillary tube 24 may be routed through a wing port in the well head (not shown) and packed off with a tube connection to pipe thread fitting similar to fitting 22 (not shown). Capillary tube 24 may then be connected to a pump mechanism providing surfactant under pressure.

Figure 3:
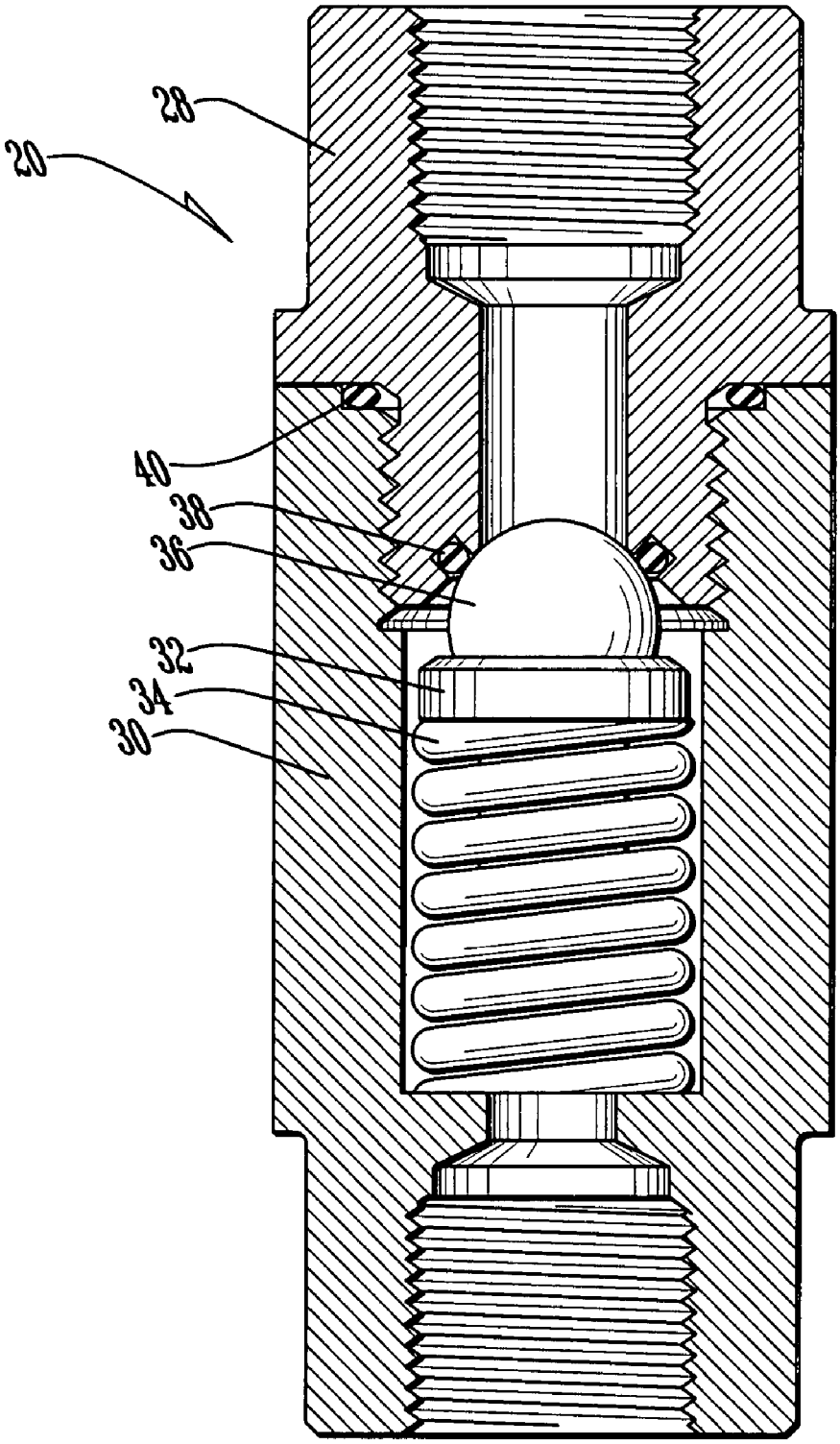
FIG. 3 is a cut-away view of a valve subassembly according to a preferred embodiment of the present invention.

Referring to FIG. 3, the internal components of valve 20 may now be described. Seat 28 and body 30 of valve 20 define a passageway through which surfactant may pass from capillary tube 24 (by way of fitting 22) into nozzle 18, and then out into production tube tip 12. Seat 28 and valve body 30 may be fitted together as by threading. Lower O-ring 40 provides a positive seal between seat 28 and body 30 of valve 20. Lower O-ring may be of conventional type, such as formed with silicone, whereby a liquid-proof seal is formed. In the preferred embodiment, Seat 28 and valve body 30 are preferably formed of stainless steel, brass, or other sufficiently durable and corrosion-resistant materials.

Flow of surfactant through valve 20 is controlled by the position of ball 36. Ball 36 is preferably a ⅜ inch diameter stainless steel ball bearing. Ball 36 may seat against upper O-ring 38, which, like lower O-ring 40, is preferably formed of silicon or some other material capable of producing a liquid-proof seal. When seated against upper O-ring 38 at seat 28, ball 36 stops the flow of surfactant out of valve 20 and into nozzle 18.

Ball 36 is resiliently held in place against upper O-ring 38 by spring 34. Spring 34 may be formed of stainless steel or other sufficiently strong, resilient, and corrosion-resistant material. The inventor is unaware of any commercially available spring with the proper force constant, and thus spring 34 in the preferred-embodiment is custom built for this application. Spring follower 32 fits between spring 34 and ball 36 in order to provide proper placement of ball 36 with respect to spring 34. As will be evident from this arrangement, a sufficient amount of pressure placed on the surfactant behind ball 36 within valve seat 28 will overcome the force of spring 34, forcing ball 36 away from upper o-ring 38 and allowing surfactant to flow around ball 36, into the interior of valve body 30 around spring 34, and out of valve body 30 and into nozzle 18. Once this pressure is released, or reduced such that it may again be overcome by the force of spring 34, valve 20 will again close and prevent the flow of surfactant through valve 20. Valve 20 thus operates as a type of one-way check valve, regulating the flow of surfactant into nozzle 18 and ensuring that surfactant only reaches nozzle 18 if a sufficient pressure is provided. This ensures that surfactant will be properly atomized by nozzle 18 upon disposition into production tube tip 12 regardless of the downhole hydrostatic pressure within the expected range of operation.

Figure 4:
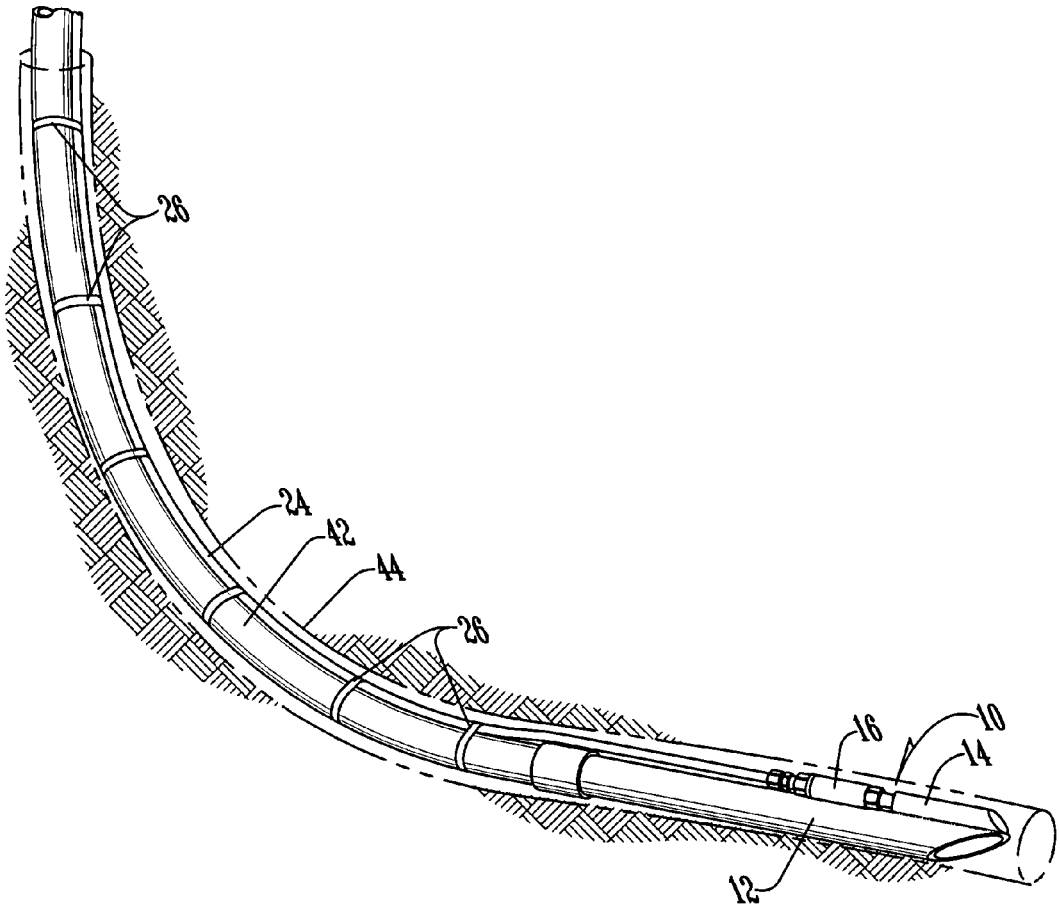
FIG. 4 is a cut-away view of a preferred embodiment of the present invention installed in a borehole.

Referring now to FIG. 4, the use of the invention with respect to the recovery of gas in a CBM well may be described. CBM wells are generally lined with a casing 44 as drilled to protect the well from collapse. The most common casing 44 sizes are 4½ inches and 5½ inches. Since the most common production tubing sizes are 2⅜ inches and 2⅞ inches, this size disparity leaves sufficient room for production tube 42 to be easily inserted and removed from casing 44. The size disparity also allows additional room for capillary tube 24 to be mounted to the exterior of production tube 42, with periodic banding 26 as described above, in order to feed valve/sprayer subassembly 16.

The above-ground components of the preferred embodiment include a chemical pump, soap tank, and defoamer tank (not shown) as are known in the art. Pumps such as the Texstream Series 5000 chemical injectors, available from Texstream Operations of Houston, Tex., may be employed. The soap tank may be a standard drum to contain surfactant material that is fed through the pump. The defoamer tank, the purpose of which is to separate gas from the surfactant for delivery, may be constructed from a standard reservoir with a top-mounted gas outlet.

Now with reference again to FIGS. 1-4, a method of recovering gas from a well according to a preferred embodiment of the present invention may be described. A horizontal well is drilled and cased with casing 44 in a manner as known in the art. Valve/sprayer subassembly 16 is then fitted to downhole injection subassembly 10, such that nozzle 18 is situated to direct the spray of surfactant into production tube tip 12. Downhole injection subassembly 10 is then fitted to the downhole end of production tube 42. Capillary tube 24 is next attached to fitting 22 of downhole injection subassembly 10. It may be noted that capillary tube 24 is preferably provided on a large roll, such that it may be fed forward as production tube 42 is fed into casing 44. At regular intervals, preferably approximately every 60 feet or so, capillary tube 24 is fastened to production tube 42 using banding 26. This operation continues until production tube tip 12 reaches the bottom of the well, situated at the formation of interest for gas recovery.

The arrangement described herein with respect to the preferred embodiment provides for a production tube 42 that is free of all obstacles, allowing unrestricted outflow of gas through production tube 42 to the surface. This feature is particularly important for gas production in "dirty" wells such as those drilled into coal formations for CBM recovery. In such environments, an unusually high number of contaminants will enter the well. It will thus be necessary to periodically swab production tube 42 and to remove coal plugs from production tube 42. With production tube 42 remaining otherwise open, it is a simple matter to run a swab the length of production tube 42 in order to clear obstacles. Otherwise, it would often be necessary to remove production tube 42 from casing 44 in order to perform maintenance. Removal of production tube 42 increases the equipment maintenance cost associated with the CBM extraction operation, and further causes significant downtime during CBM extraction.

As gas recovery begins, surfactant is forced into capillary tube 24 under sufficient force to overcome the combined force of spring 34 and the downhole hydrostatic pressure and thereby open valve 20. In the preferred embodiment, valve 20 is constructed such that surfactant is injected through nozzle 18 at a pressure of no less than 300 pounds per square inch. This pressure ensures that the surfactant is atomized upon entry into production tube tip 10, thereby creating the best foam when mixed with available water. The production of high-quality foam lowers the hydrostatic head pressure at the bottom of the well, allowing gas to flow up production tube 42 along with the foam utilizing only the hydrostatic pressure at the bottom of the well. The elimination of external pressure to force gas upward minimizes the damage that might otherwise occur to the formations from which gas is recovered, which would lower production rates and expected well lifetime.

It may be noted that the feature of directing nozzle 18 into production tube tip 12, rather than into the formation, is particularly important in CBM recovery. The long lateral strata common to coal formations do not allow for a homogenous porosity state of coal/gas. Thus the water and gas influx across the face of the formation are very erratic in typical horizontal wells. If it should occur that the hydrostatic pressure drops and water is not present at production tube tip 12, the surfactant still will be carried in an atomized state up and out of the production tube 42, rather than into the formation. As already noted, surfactant introduced into the formation will lower the output and operational lifetime of the well.

In addition, the ability to vary the pressure at valve 20 is particularly useful with regard to such wells due to the erratic nature of the hydrostatic pressure across a formation. The pressure of the surfactant introduced to valve 20 is varied in response to an observation of foam quality at the output of production tube 42. In the preferred embodiment this operation is performed by visual inspection and hand manipulation of the pressure, although automatic sensing equipment could be developed and employed in alternative embodiments of the present invention. The pressure of surfactant can be optimized in a matter of minutes, since the only delay in determining foam quality is the time that is required for foam to reach the top of production tube 42. Previous methods would require days of production and subsequent yield analysis before an optimum surfactant introduction rate could be determined, due to the delay caused by slowly trickling surfactant down the casing of production tube 42. The pressure at valve 20 can also be adjusted according to well depth, which is a factor in the hydrostatic pressure present. In the preferred embodiment, the pressure at valve 20 may be adjusted to correspond to expected hydrostatic pressures at depths of anywhere from 500 to 20,000 feet.

The present invention has been described with reference to certain preferred and alternative embodiments that are intended to be exemplary only and not limiting to the full scope of the present invention as set forth in the appended claims.

What is claimed is:

1. An apparatus for hydrocarbon recovery in a well comprising a downhole portion, the apparatus comprising:

(a) a capillary tube comprising a downhole end, wherein said downhole end is positioned within the downhole portion of the well;

(b) a fluid introduced into said capillary tube, wherein the fluid is different from species naturally existing in the well and wherein the fluid is mixed with a hydrocarbon in the well to form a hydrocarbon foam comprised of the fluid and the hydrocarbon;

(c) a pump operable to apply to said fluid a pressure sufficient to overcome a hydrostatic pressure in the downhole portion of the well; and (d) a valve attached at said downhole end of said capillary tube, wherein said valve is a one-way valve operable to open and thereby deliver the fluid from said capillary tube through the valve and into the downhole portion of the well only when the pressure applied to the fluid is sufficient to deliver the fluid into the downhole portion of the well.

2. The apparatus of claim 1, further comprising a nozzle attached downstream of said valve whereby the fluid is delivered from said valve through said nozzle into the well and the fluid is atomized at said nozzle.

3. The apparatus of claim 1, wherein said valve comprises a spring, a seat, and a ball in communication with said spring and said seat, and wherein said spring biases said ball against said seat, thereby closing said valve when said ball rests against said seat.

4. The apparatus of claim 3, wherein said spring compresses to open said valve if the pressure on the fluid within said capillary tube is greater than the downhole hydrostatic pressure.

5. The apparatus of claim 4, wherein said spring compresses to open said valve upon the application of a pressure of about 300 pounds per square inch greater than the downhole hydrostatic pressure.

6. The apparatus of claim 1, wherein said valve is operable to open if the pressure on the fluid within said capillary tube is greater than the downhole hydrostatic pressure.

7. The apparatus of claim 6, wherein said valve is operable to open upon the application of a pressure of about 300 pounds per square inch greater than the downhole hydrostatic pressure.

8. The apparatus of claim 1, further comprising a production tube positioned within the well.

9. The apparatus of claim 8, wherein said capillary tube is positioned outside of said production tube.

10. The apparatus of claim 9, further comprising a plurality of bands binding said capillary tube to said production tube.

11. The apparatus of claim 9, further comprising a nozzle attached downstream of said valve whereby the fluid is delivered from said valve through said nozzle into said production tube.

12. The apparatus of claim 11, wherein said production tube comprises an orifice and wherein said nozzle is directed to deliver the fluid through said orifice and into the interior of the production tube.

13. The apparatus of claim 9, further comprising a nozzle attached downstream of said valve whereby the fluid is delivered from said valve through said nozzle near a downhole end of said production tube.

14. The apparatus of claim 1, wherein the fluid is a liquid.

15. The apparatus of claim 14, wherein the liquid is a surfactant.

16. A method of recovering a hydrocarbon from a well with an apparatus, the well comprising a production tube, the apparatus comprising:

(a) a capillary tube comprising a downhole end, wherein said downhole end is positioned within a downhole portion of the well;

(b) a fluid introduced into said capillary tube;

(c) a pump operable to apply to said fluid a pressure sufficient to overcome a hydrostatic pressure in the downhole portion of the well;

(d) a valve attached at said downhole end of said capillary tube, wherein said valve is a one-way valve operable to open and thereby deliver the fluid from said capillary tube through the valve and into the downhole portion of the well only when the pressure applied to the fluid is sufficient to deliver the fluid into the downhole portion of the well;

wherein the method comprises the steps of:

(a) passing the capillary tube into the well outside of the production tube;

(b) injecting the pressurized fluid through the capillary tube;

(c) delivering the fluid;

(d) directing the fluid from outside of the production tube to inside the production tube, thereby forming a hydrocarbon foam comprised of the fluid and the hydrocarbon; and (e) recovering the hydrocarbon foam from the well.

17. The method of claim 16, wherein the well comprises a downhole hydrostatic pressure, and said injecting step comprises a step of adjusting the pressure of the fluid in the capillary tube to exceed the downhole hydrostatic pressure in the well.

18. The method of claim 17, wherein said step of adjusting the pressure of the fluid in the capillary tube comprises the step of adjusting the pressure of the fluid in the capillary tube to be at least about 300 pounds per square inch greater than the downhole hydrostatic pressure.

19. The method of claim 16, wherein the well comprises a downhole hydrostatic pressure, and said injecting step comprises the step of adjusting the pressure of the fluid in the capillary tube to exceed the downhole hydrostatic pressure in the well.

20. The method of claim 19, wherein said step of adjusting the pressure of the fluid in the capillary tube comprises the step of adjusting the pressure of the fluid in the capillary tube to be at least about 300 pounds per square inch greater than the downhole hydrostatic pressure.

21. The method of claim 16, wherein said delivering step comprises the step of delivering the fluid through a nozzle downstream from the valve.

22. The method of claim 16, wherein said delivering step comprises the step of directing the fluid through an orifice in the production tube.

23. The method of claim 16, wherein the fluid is atomized upon delivery into the downhole portion of the well.

24. The method of claim 16, wherein the fluid is a surfactant.

25. An apparatus for hydrocarbon recovery in a well comprising a downhole portion, the apparatus comprising:

(a) a capillary tube comprising a downhole end, wherein said downhole end is positioned within the downhole portion of the well;

(b) a fluid introduced into said capillary tube, wherein the fluid is mixed with a hydrocarbon in the well to form a hydrocarbon foam comprised of the fluid and the hydrocarbon;

(c) a pump operable to apply to said fluid a pressure sufficient to overcome a hydrostatic pressure in the downhole portion of the well; and (d) a valve attached at said downhole end of said capillary tube, wherein said valve is a one-way valve operable to open and thereby deliver the fluid from said capillary tube through the valve and into the downhole portion of the well only when the pressure applied to the fluid is sufficient to deliver the fluid into the downhole portion of the well.

* * * * *